US010711398B2

(12) United States Patent
Schneiders et al.

(10) Patent No.: US 10,711,398 B2
(45) Date of Patent: Jul. 14, 2020

(54) LOW SLIP SPLICE

(71) Applicant: DSM IP ASSETS B.V., Heerlen (NL)

(72) Inventors: Hans Schneiders, Echt (NL); Karel Jozef Wetzels, Echt (NL); Michael Hubertus Helena Meuwissen, Echt (NL)

(73) Assignee: DSM IP ASSETS B.V., Heerlen (NL)

( * ) Notice: Subject to any disclaimer, the term of this patent is extended or adjusted under 35 U.S.C. 154(b) by 304 days.

(21) Appl. No.: 15/553,262

(22) PCT Filed: Feb. 26, 2016

(86) PCT No.: PCT/EP2016/054118
§ 371 (c)(1),
(2) Date: Aug. 24, 2017

(87) PCT Pub. No.: WO2016/059261
PCT Pub. Date: Apr. 21, 2016

(65) Prior Publication Data

US 2018/0245284 A1 Aug. 30, 2018

(30) Foreign Application Priority Data

Mar. 2, 2015 (EP) ..... 15157134

(51) Int. Cl.
*D07B 7/16* (2006.01)
*D07B 1/18* (2006.01)
(Continued)

(52) U.S. Cl.
CPC ..... *D07B 7/169* (2015.07); *D04C 1/00* (2013.01); *D04C 1/02* (2013.01); *D04C 1/12* (2013.01);
(Continued)

(58) Field of Classification Search
CPC ..... D07B 7/18; D07B 7/169; D07B 7/167; D07B 1/185
See application file for complete search history.

(56) References Cited

U.S. PATENT DOCUMENTS 2,418,524 A 4/1947 Peterson et al.
4,191,009 A * 3/1980 Thomson ..... D07B 7/169 57/202
(Continued)

FOREIGN PATENT DOCUMENTS

EP 0 269 151 6/1988
EP 1 699 954 11/2011
(Continued)

OTHER PUBLICATIONS

International Search Report for PCT/EP2016/054118, dated Apr. 28, 2016, 4 pages.
(Continued)

*Primary Examiner* — Tajash D Patel
(74) *Attorney, Agent, or Firm* — Nixon & Vanderhye P.C.

(57) ABSTRACT

A rope system (10, 20) comprising a splice structure (12, 22) with an intact portion (23) comprising at least 8 intact strands (32, 34), and a disassembled portion (26) comprising at least 4 loose strands (30), wherein the intact portion (23) is a braid of at least 4 S oriented (32) and at least 4 Z oriented intact strands (34), wherein at least one loose strand (30) of the disassembled portion (26) passes under and over intact strands (32, 34) of the intact portion (23), and at least one loose strand (30) passes under at least one X-tuck (38) of intact strands (32, 34). By this means the splice length can be minimized resp. slippage of the splice at high loads can be avoided.

30 Claims, 5 Drawing Sheets

(51) Int. Cl.

| | |
|---|---|
| ***D04C 1/00*** | (2006.01) |
| ***D04C 1/02*** | (2006.01) |
| ***D04C 1/12*** | (2006.01) |
| ***D07B 1/02*** | (2006.01) |
| *D07B 1/14* | (2006.01) |

(52) U.S. Cl.

CPC ..... *D07B 1/025* (2013.01); *D07B 1/185* (2013.01); *D07B 1/142* (2013.01); *D07B 2201/1096* (2013.01); *D07B 2201/2041* (2013.01); *D07B 2201/2044* (2013.01); *D07B 2205/10* (2013.01); *D07B 2205/106* (2013.01); *D07B 2205/20* (2013.01); *D07B 2205/201* (2013.01); *D07B 2205/205* (2013.01); *D07B 2205/2014* (2013.01); *D07B 2205/2028* (2013.01); *D07B 2205/2042* (2013.01); *D07B 2205/2046* (2013.01); *D07B 2205/2071* (2013.01); *D07B 2205/2096* (2013.01); *D07B 2205/3003* (2013.01); *D07B 2205/3007* (2013.01); *D07B 2205/3025* (2013.01); *D07B 2205/3067* (2013.01); *D07B 2401/207* (2013.01)

(56) References Cited

U.S. PATENT DOCUMENTS

| | | | | |
|---|---|---|---|---|
| 6,422,118 | B1 * | 7/2002 | Edwards ..... | B65H 69/06 28/141 |
| 7,107,749 | B2 * | 9/2006 | Wetzels ..... | D07B 7/18 57/202 |
| 8,707,666 | B2 | 4/2014 | Crozier et al. | |
| 8,713,905 | B1 * | 5/2014 | Branscomb ..... | D07B 7/18 57/202 |

FOREIGN PATENT DOCUMENTS

| | | |
|---|---|---|
| WO | WO 01/73173 | 10/2001 |
| WO | WO 2011/015485 | 2/2011 |
| WO | WO 2014/069083 | 5/2014 |

OTHER PUBLICATIONS

Written Opinion of the ISA for PCT/EP2016/054118, dated Apr. 28, 2016, 5 pages.

* cited by examiner

LOW SLIP SPLICE

This application is the U.S. national phase of International Application No. PCT/EP2016/054118 filed 26 Feb. 2016, which designated the U.S. and claims priority to EP Patent Application No. 15157134.6 filed 2 Mar. 2015, the entire contents of each of which are hereby incorporated by reference.

The present invention relates to rope systems, more specifically to systems for splicing ropes. Rope splicing refers to the formation of a joint between two ropes or two parts of the same rope by partly disassembling and interweaving strands of the rope or ropes.

A splice can retain a very high percentage of the strength of the original rope, but the splice tends to create a thickened portion of the rope. In some situations, a thickened region of a rope can alter the operating characteristics of the rope and/or the manner in which the rope interacts with structures or mechanical assemblies for guiding and/or securing the rope.

U.S. Pat. No. 8,707,666 provides a solution by describing a short splice system for ropes.

Although such rope splices as for example described in U.S. Pat. No. 8,707,666 have reduced the lengths of the thickened rope portion there is still a need for further reduction of the splice length.

Furthermore it is observed that for some rope systems, especially ropes comprising high-modulus, high-strength fibres and/or a low coefficient of friction, splices may start to slip before the maximum break load of the rope system is reached. Although slippage of a splice and hence strength of a rope system can be countered by an—undesired—increase of the splice length, it does appear that above a certain splice length the additional effect is limited and might require unrealistic long splices.

Accordingly the aim of the present invention is to provide a rope system comprising a shorter splice structure. Another aim of the invention is to provide a rope system with a splice that is not subject to slippage at high loads or a splice that starts to slip at higher loads than splices of comparable length. Hence the present invention relates to a particular form of rope splicing herein referred to as a low slip splice. A low slip splice minimizes the slippage of a splice even at reduced length of the thickened portion of the rope and thus minimizes some of the adverse effects of the splice on the operating characteristics of the rope. In some instances a low slip splice will increase the maximum strength of a rope system by avoiding that splice slipping becomes the weakest element in said rope system.

Surprisingly the aim of the invention was achieved by a rope system comprising a splice structure comprising an intact portion comprising at least 8 intact strands, and a disassembled portion comprising at least 4, preferably 8, loose strands wherein the intact portion is a braid of at least 4 S oriented and at least 4 Z oriented intact strands wherein at least one loose strand of the disassembled portion passes under and over intact strands of the intact portion, wherein at least one loose strand passes under at least one crossing defined by at least one S and one Z oriented intact strand, i.e. an X-tuck of intact strands.

It was observed by the inventors that such a rope system substantially increases the strength of the splice compared to known splice structures of equal or even higher splice length. In some cases the inventive rope system allows a reduction of the splice length without the splice becoming the weakest element of said rope system.

The present invention is of particular significance in the context of forming an eye splice. However, the present invention also covers application of splices other than eye splices where short and/or low slip splices may be used. Typical applications other than eye splices may be end-to-end splices between two or more ropes or to join ends of the same rope to form a circular grommet or round slings.

The present invention may also be embodied as a rope system comprising a braided rope structure defining an interior and an exterior and comprising an intact portion comprising at least 4 intact S-strands and at least 4 intact Z-strands and a disassembled portion comprising at least 4, preferably at least 8, loose strands. Each intact S-strand crosses a plurality of intact Z-strands. Each intact Z-strand crosses a plurality of intact S-strands, forming X-tucks of intact strands. The plurality of loose strands may be passed into the interior of the rope structure. At least one, preferably each, loose strand is extended under and over the intact strands and at least under one X-tuck of intact strand.

The present invention may also be embodied as a method of forming a rope system comprising the following steps. A braided rope structure of at least 8 strands is provided. The braided rope structure comprises an intact portion comprising at least 4 intact S-strands and at least 4 intact Z-strands and a disassembled portion comprising at least 4, preferably at least 8 loose strands. The intact S and Z strands cross each other in the intact braided structure forming X-tucks of intact strands. At least one, preferably each, loose strand is extended under and over the intact strands and at least under one X-tuck of intact strand.

BRIEF DESCRIPTION OF THE DRAWINGS

FIG. 1(*b*) is a top plain view of a rope structure using on example rope end splice system constructed in accordance with, and embodying, the principle of the present invention.

It should be noted that the FIGS. 2-5 are somewhat schematic in that the three-dimensional rope structure is represented in 2 dimensions without tension applied. The schematic figures may only represent a portion of the untensioned rope system and one may imagine the loosened rope structure by joining the edges of the figures to for a cylindrical structure. Such schematic drawing is employed for increased visibility of the respective positions of the intact and loose strands of the rope system whereby the rope systems according to the invention are described and defined in their tensioned state. It is clear that upon tensioning the individual intact and loose strands may shift one against the other but in the present figures should substantially maintain their relative positioning, especially between intact and loose strands. It was observed that comparable schematic figures from the prior art, such as U.S. Pat. No. 8,707,666, also represent rope structures in their loosened form and will be subject to substantial shifting of strands upon tensioning the structure.

Figure 1:
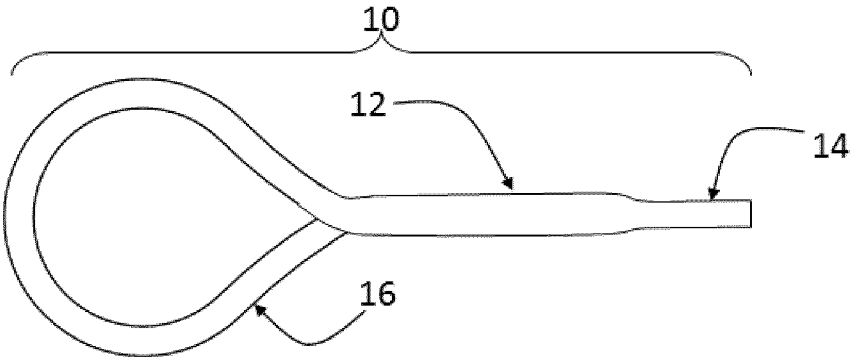
FIG. 1(*a*) is a top plan view of a rope structure using an example eye splice system constructed in accordance with, and embodying, the principles of the present invention.
Figure 1:
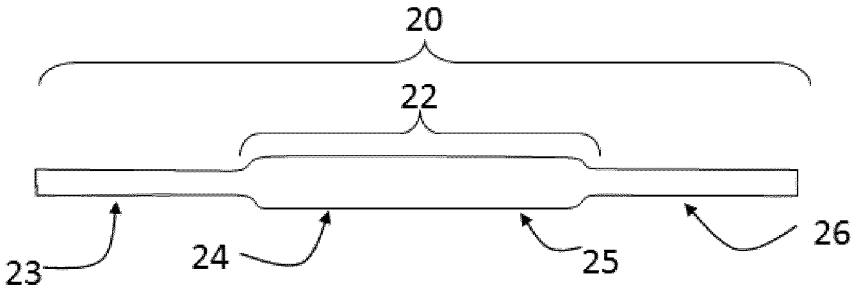

In FIG. 1(*a*) of the drawings is represented an example rope system 10 comprising an eye splice structure 12 according to the present invention. The example splice structure 12 defines a main portion 14 and an eye portion 16 of the rope system 10.

In FIG. 1(*b*) of the drawings is represented an example rope system 20 comprising a splice structure 22 according to another embodiment of the present invention connecting a first rope end 23 with a second rope end 26. The example splice structure comprises a splice section 24 where the loose strands of the second rope en 26 are spliced into the intact strands of the first rope end and a second splice section 25 where the loose strands of the first rope en 23 are spliced into the intact strands of the second rope end 26.

Figure 2:
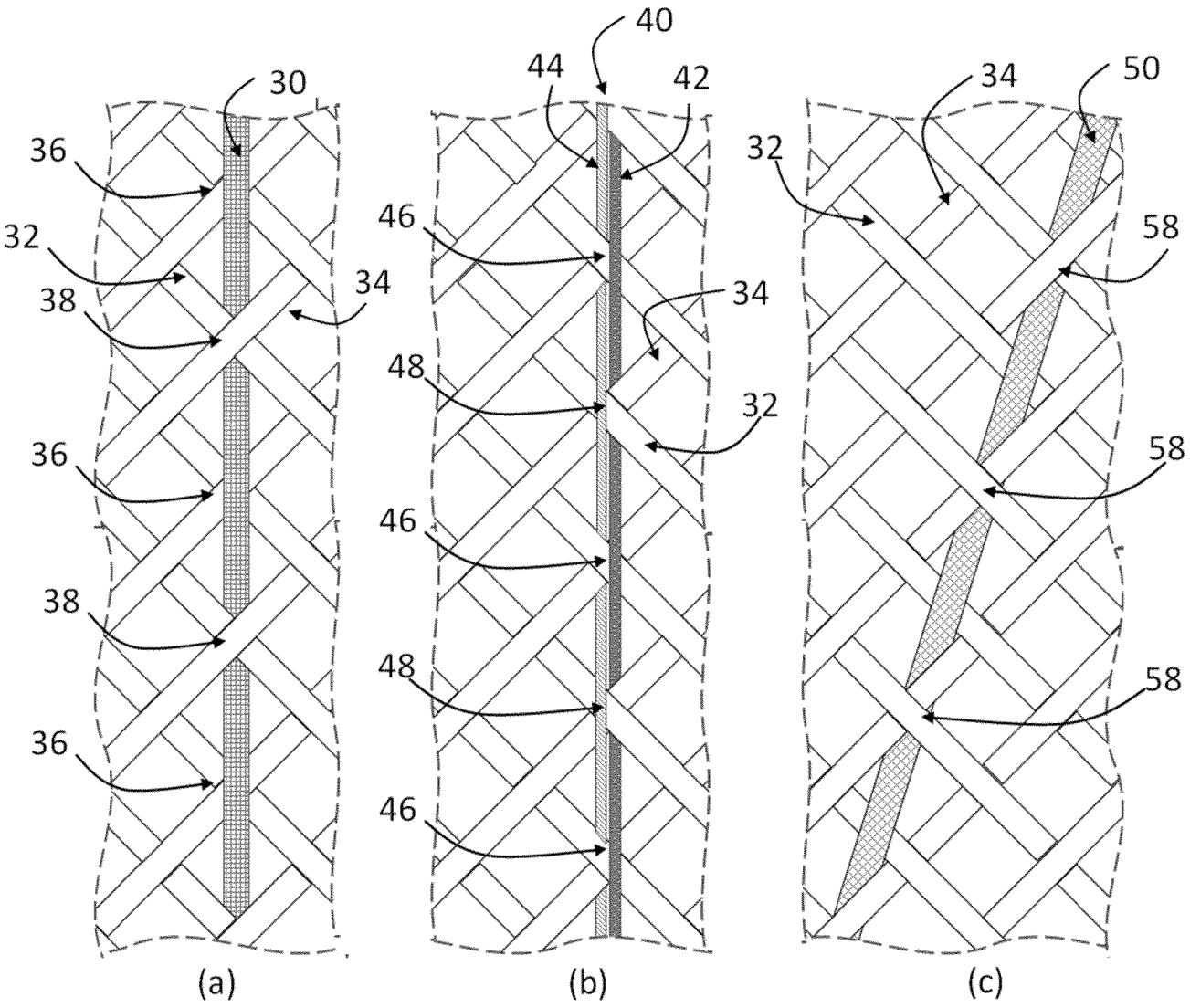
FIG. 2 is a two-dimensional view illustrating examples (a) to (c) of individual loose strands passed through the intact portion.

FIG. 2 of the drawings represents 3 examples of loose strands (30, 40, 50) interwoven with the intact strands 32 and 34 according to different embodiments of the present invention.

FIG. 2*a* represents a loose strand 30 passing over 36 and under 38 X-tucks formed by the S-strands 32 and Z-strands 34 respectively.

FIG. 2*b* represents loose strands 40 as a pair of associated loose strands 42 and 44 with one loose strand 42 passing under 48 and over 46 consecutive X-tucks formed by the S-strands 32 and Z-strands 34 and the associated loose strand 44 passing over 48 and under 46 said X-tucks formed by the S-strands 32 and Z-strands 34.

FIG. 2*c* represents loose strands 50 as a loose strand passing alternatively over Z-strands 34 of the intact portion and under X-tucks 58 formed by the S-strands 32 and Z-strands 34 of the intact portion.

Figure 3:
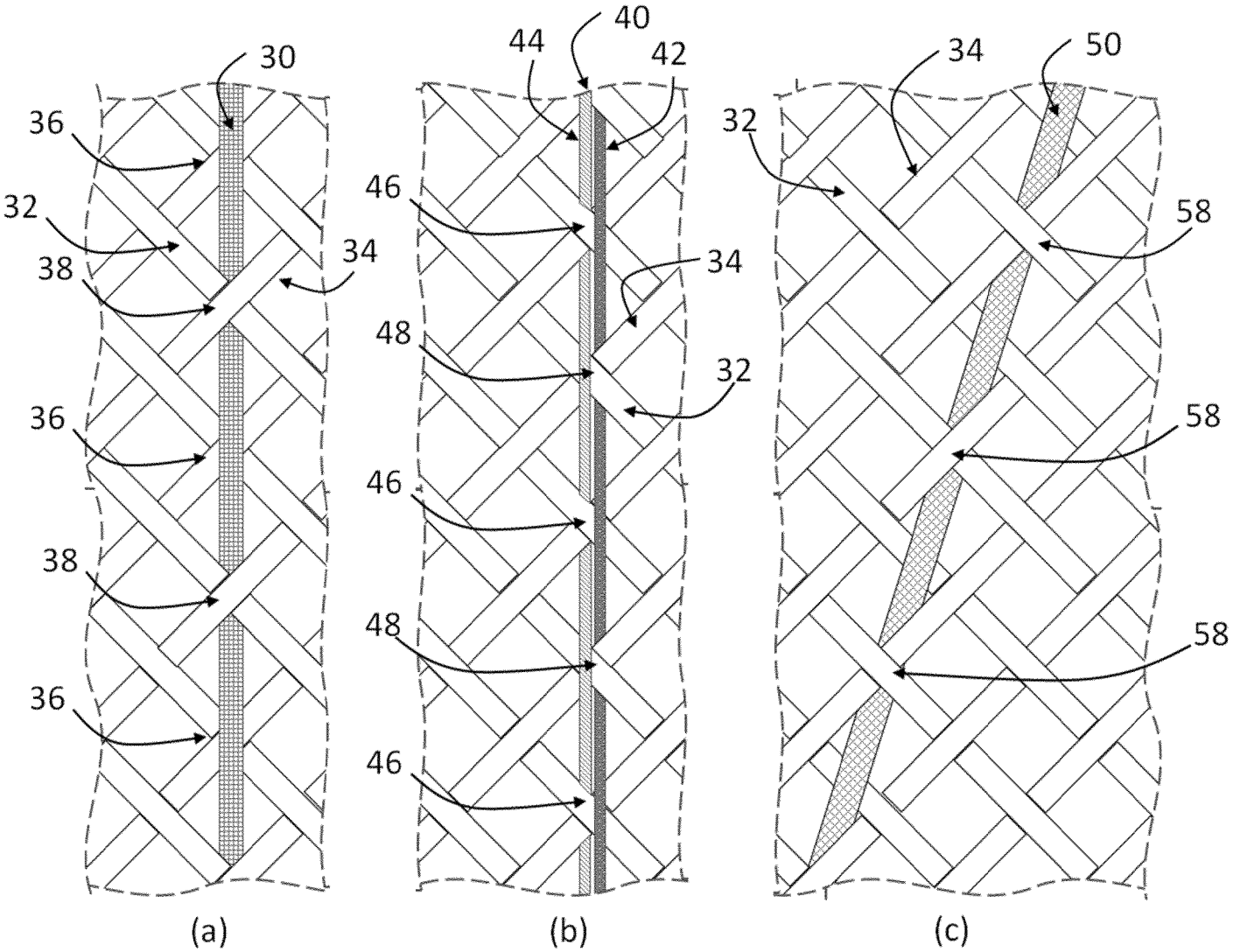
FIG. 3 is a two dimensional view illustrating examples (a) to (c) of individual loose strands passed through the intact portion.

FIG. 3 of the drawings represents 3 examples of loose strands identical to the examples of FIG. 2 but wherein the intact strands 32 and 34 forming the intact portion of the splice are interwoven as in an alternative braiding structure. All 3 constructions are equal in design and numbering as compared to FIG. 2.

Figure 4:
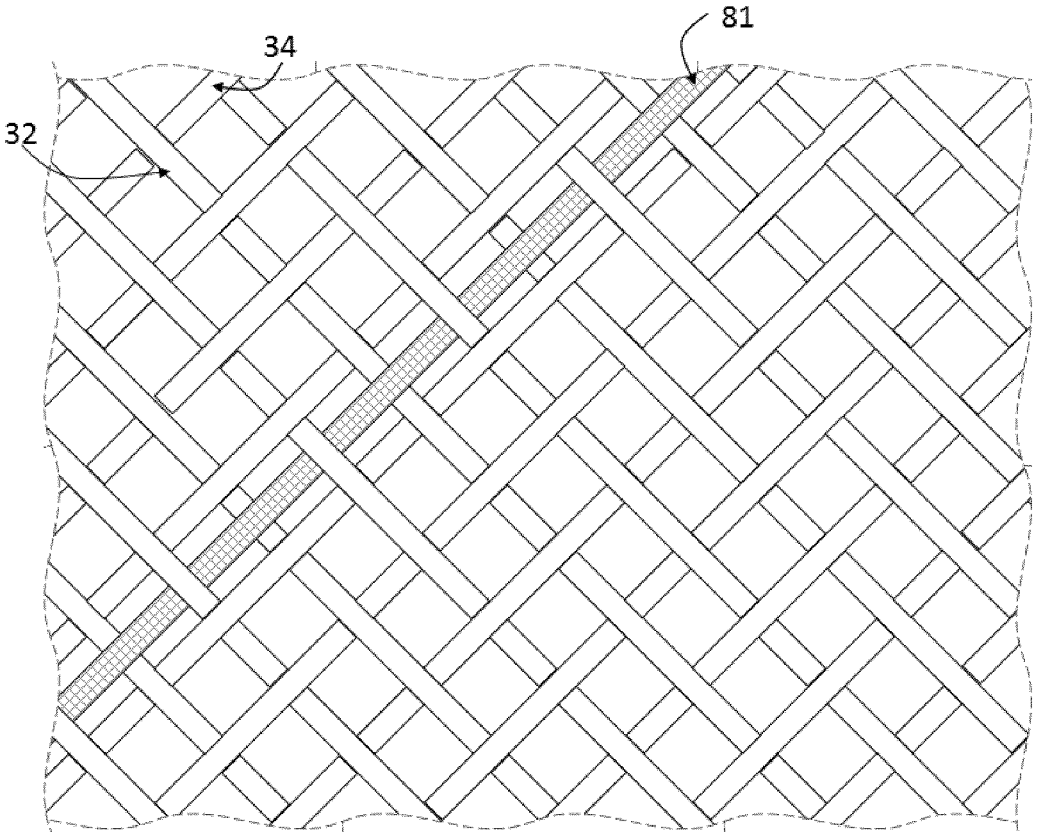
FIGS. 4 and 5 are a two-dimensional views illustrating comparative examples of loose strands passed through the intact portion.
Figure 5:
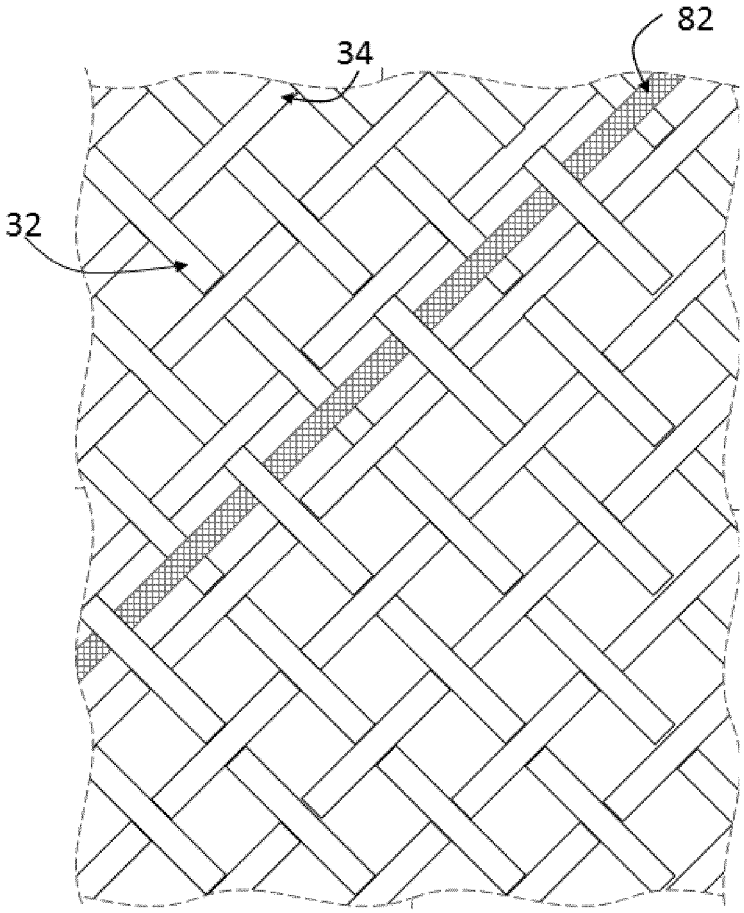

FIGS. 4 and 5 represent comparative examples of loose strands 81 and 82 that are interwoven with intact strands 32 and 34 of the splice structure. Loose strands 81 and 82 pass under and over intact S-strands, in parallel to the intact Z-strands.

A rope system according to the invention comprises at least one rope. In the case of an eye splice, the rope system comprises one rope defining a first or proximal end (may also be referred to as the bitter end or tail) and a second or distal end (may also be referred to as the standing end). The distal end, the eye and the intact portion of the splice has a braided structure comprising at least 8 strands, but may comprise more strands such as for example 12 or 16. The invention hence relates to a rope system wherein the splice structure is an eye splice between an intact portion and a disassembled portion of the same rope and wherein the intact strands and loose strands are portions of the same rope strands. Herein the proximal end of the rope is disassembled into loose strands for a length of approximately the splice length. The loose strand length is associated with a portion of the rope structure that is unbraided, or otherwise disassembled to obtain individual loose strands of the rope structure having sufficient length to form the splice system.

In another embodiment of the invention the rope system may be a joint between at least 2 rope ends, the splice comprising an intact portion of a first rope end and a disassembled portion of a second rope end. The intact portion of the first rope end preferably comprises at least 8 strands whereby the disassembled second rope end comprises at least 4 loose strands, preferably at least 8 loose strands. Most preferably the number of strands of the 2 ropes are substantially equal. The 2 rope ends may be of the same or two distinct ropes forming a connection between 2 ropes or forming a sling of one rope.

In a further preferred embodiment of a rope system being a joint between 2 rope ends, the rope system comprises a second splice structure comprising an intact portion of the second rope end and a disassembled portion of the first rope end, wherein said further splice structure is according to the splice of the invention. Such a splice between 2 rope ends may be understood as an end to end (or in-line or butt splice) connection between the 2 ropes or 2 ends of one rope, whereby along the rope axis several sections engender one into the other starting with the main section of the first rope or rope end followed by a first splice comprising the intact strands of the first rope or rope end and the loose strands of the second rope or rope end, followed by a second splice comprising the intact strands of the second rope or rope end and the loose strands of the first rope or rope end and finally the main section of the second rope or rope end. Preferably one or both of the splice sections may be tapered by for example gradually reducing the number of yarns of some loose strands as further discussed below.

In the case the rope system is an eye splice or connecting the two ends of the same rope, the number of loose strands is substantially equal to the number of strands present in the distal end and/or the intact portion of the splice.

In a preferred embodiment, the at least one loose strand passes at least once under and once over X-tucks of intact strands. Such preferred arrangement of the loose strand is depicted in FIGS. 2*a* and 3*a* where the loose strand 30 is alternatingly passing over 36 and under 38 X-tucks of the intact splice portion. The inventors identified that such arrangement may be produced more easily than other constructions but mainly increase the splice efficiency and consequently the overall strength of the rope structure.

In another preferred embodiment, each loose strand of the disassembled portion passes under and over the intact strands of the intact portion wherein each loose strand passes under at least one X-tuck 38 of intact of strands. Such splice structure will be recognized as providing a variant of the invention, with each of the loose strands being interwoven in a similar way with the intact strands of the splice portion, and running parallel to one another. Such arrangement will result in even further improved slip performance since all loose strands participate in the splice in equal manner.

In another preferred embodiment of the invention, each loose strand passes at least once under and once over a first and a second X-tuck of intact strands respectively, as shown for one or two strands on FIGS. 2*a*, 2*b*, 3*a* and 3*b*. Such splice structure will be recognized as providing a symmetrical variant of the invention, with each of the loose strands being interwoven in a similar way with the intact strands of the splice portion and running in parallel to the rope direction. Such arrangement provides improved slip performance since all loose strands participate in the splice in equal manner and have a reduced splice diameter.

In one embodiment of the invention, the loose strands are grouped in bundles of loose strands. The combination of strands into bundles comprising 2 or more strands substantially reduce the complexity of the splice and the time needed to manufacture the splice. Depending upon the number of strands in the loose section of the splice may the strands conveniently be assembled into bundles of 2, 3 or more strands. The inventors observed that bundles of 2 strands represent an optimum between splice complexity and splice efficiency, but especially for rope structures with higher number of loose strands bundles of 3 or more may be preferred to reduce splicing costs. Accordingly is a preferred embodiment of the invention a rope system wherein at least 2 of the loose strands are combined into at least one bundle of loose strands, wherein the at least one bundle of loose strands passes under at least one X-tuck of intact strands respectively, preferably the bundle is a pair of loose strands. In a further preferred embodiment all loose strands are combined into bundles of at least 2 loose strands, preferably each bundle is a pair of loose strands.

In an alternative embodiment of the invention, represented for example by FIGS. 2*b* and 3*b*, the loose strands are combined to associated loose strands. It was observed that the combination of strands into associated strands of 2 or more strands according to this embodiment represents a further improvement of the splice performance.

In such a rope structure at least one loose strand passes at least once under and once over a first and a second X-tuck of intact strands respectively and an associated loose strand passes, in an alternate manner, out of phase, over and under said first and second X-tuck respectively, preferably all loose strands are combined in pairs of associated loose strands wherein each a first loose strand of an associated pair passes at least once under and once over a first and a second X-tuck of intact strands respectively and wherein each second associated loose strand passes, out of phase, over and under said first and second X-tuck respectively. A representation of such structure is given for the strands 42 and 44 of FIGS. 2*b* and 3*c* where it can be observed that such rope structure will comprise loose strands that not only pass under an X-tuck 46, 48 of 2 intact strands but under a crossing of as much as 3 strands, namely 2 intact strands and the associated loose strand. Such association of loose strands could be referred to as one-over-one-under construction, making allusion to the location of the associated strands in respect of the X-tuck. It was observed that such splice, despite the additional complexity of the rope structure, showed further reduction of splice slippage.

Once the at least one loose strand, preferably all the loose strands, has passed under at least one X-tuck of intact strands and over intact strands, the at least one loose strand, preferably all the lose strands, may be further worked into the splice according to standard techniques in the art. Nevertheless it was observed that when the at least one loose strand, preferably all the loose strands, passes at least twice under a X-tuck of intact strands and over intact strands, the slippage of the rope structure is further reduced. While the loose strands may successively pass under 2 or more X-tucks of intact strands before passing over intact strands, or may successively pass over 2 or more intact strands before passing under an X-tuck of intact strands is it a preferred embodiment that the loose strands pass under X-tucks of intact strands and over intact strands in an alternating pattern. It was observed that such alternating pattern of the at least one loose strand, preferably all loose strands, further reduces the splice length of the rope structure. Accordingly is a yet preferred embodiment of the present invention a rope system wherein at least one loose strand, preferably all loose strands, passes at least n times under a X-tuck and in total at least n times over intact strands or X-tucks of intact strands, with n being 2, preferably 3, more preferably 4. Most preferably the at least one loose strand, preferably all loose strands, passes n times under a X-tuck and over an intact strand or a X-tuck of intact strands, with n being at least 2, preferably at least 3, more preferably at least 4.

It should be noted that FIGS. 2-5 are somewhat schematic in that the three-dimensional rope structure is represented in two-dimensions. In particular, when loosened (e.g., removing tension on the rope structure) the example rope structure takes the form of a hollow, generally cylindrical structure having an interior space. As depicted in FIGS. 2-5, the left and right edges of the rope structure may be rolled together and connected to define this cylindrical structure. The ends of the loose strands may be inserted into the interior space of the rope structure at the beginning of the splice structure.

It should further be noted that the individual braids of a braided rope structure are aligned with what is typically referred to as an S-strands 32 or a Z-strands 34. The S-strands 32 are typically radially offset from each other, and the Z-strands 34 are typically radially offset from each other. The S-strands are intertwined with the Z-strands for a particular rope structure.

Typically, one half of the strands of any given rope structure will be S-strands, and the other half will be Z-strands. The "S" and "Z" in the terms identify the direction of the twist of the particular helical axis. In particular, the center portions of the letters "S" and "Z" (\ and /) forms a mnemonic device for remembering and identifying the strands of a braided rope structure.

The skilled person will be familiar with the production of tapered splices wherein the loose strands are terminated after having passed several times under and over the intact strands of the splice. Typically all loose strands pass at least 2 times, preferably 3 times under and over intact strands before a fraction of the loose strands, preferably at least one sixth, more preferably at least one quarter and most preferably one third is terminated. Accordingly is a preferred embodiment of the invention a rope system wherein a fraction of loose strands is terminated before the remaining of the loose strands, preferably the fraction of loose strands are terminated after passing at least 2 times under a X-tuck. The not terminated loose strands will be further passed at least 2 times, preferably 3 times under and over intact strands before another at least one sixth, more preferably at least one quarter and most preferably one third of the totality of loose strands is terminated. Depending upon the termination fraction, the tapering may be repeated several more times until the entire amount of loose strands is terminated. The cross-sectional area of the splice thus decreases from the eye portion to the main portion of the rope. Reducing the fraction of terminated strands in each step provide a more gradual decrease in cross-sectional area while the splice becomes longer. An optimum between splice length and splice slippage for the present inventive splice was found to be a gradual decrease of one third of the loose strands after respectively passing under 2, 4 and 6 X-tucks or alternatively under 3, 5 and 7 X-tucks.

For definition purpose of the hierarchical levels of a rope in the context of the present invention is it considered that a rope may amongst others be composed of filaments, fibres, baseyarns, ropeyarns, strands and rope. In the following it is understood that fibers and/or filaments will form baseyarns, baseyarns are within ropeyarns, ropeyarns within strands and strands within ropes.

The rope system of the present invention is found to be suitable for splicing any type of braided rope, independent upon the fibrous composition of the strands. In particular the strands or yarns may comprise natural or synthetic fibres, preferably synthetic fibers, more preferably high modulus synthetic fibers, most preferably high modulus polyethylene fibers.

The strands are preferably manufactured from yarns comprising natural and/or synthetic filaments. Examples of natural materials that may be used to manufacture the yarns include cotton, hemp, wool, silk, jute and linen. Synthetic fibres may comprise organic or inorganic materials. Typical inorganic fibres may be metal fibres, such as steel, copper, silver fibres, glass fibres, carbon fibres or the like. Organic synthetic yarns, also known as polymeric yarns, may comprise a wide variety of polymeric materials and may be produced according to any technique known in the art, preferably by melt, solution or gel spinning.

The polymeric material is preferably a thermoplastic polymer that is selected from the group consisting of polyolefins e.g. polyethylene, polyesters, polyvinyl alcohols, polyacrylonitriles, polyamides or polyketone. Suitable polyamides are, for example, the aliphatic polyamides PA-6, PA-6,6, PA-9, PA-11, PA-4,6, PA-4,10 and copolyamides thereof and semi-aromatic polyamides based on for example PA-6 or PA-6,6 and aromatic dicarboxylic acids and aliphatic diamines, for example isophthalic acid and terephthalic acid and hexanediamine, for example PA-4T, PA-6/6,T, PA-6,6/6,T, PA-6,6/6/6,T and PA-6,6/6,I/6,T. Preferably PA-6, PA-6,6 and PA-4,6 are chosen. Furthermore, also polyamide blends are suitable. Suitable thermoplastic polyesters are, for example, poly(alkylene terephthalate)s, like polybutyleneterephthalate (PBT), polytrimethyleneterephthalate (PTT), polyethyleneterephthalate (PET), polycyclohexanedimethyleneterephthalate (PCT), and poly (alkylene naphthanate)s, like polyethylenenaphthanate (PEN), and copolymers and mixtures. Preferably the yarns comprises a polyolefin, more preferably a polyethylene and most preferably an ultra high molecular weight polyethylene. Most of the fibres and yarns comprising above enumerated materials have a high coefficient of friction and an average strength and hence are the state of the art splices sufficiently suited to form as rope splice comprising such yarns. Nevertheless it is the advantage of the herein described inventive splice construction that compared to a state of the art splices, the splice length can be substantially reduced, i.e. that the for the same rope, the splice length can be reduced by at least one, preferably by several tucks. For example is it reported in the examples that a state of the art splice in a lubricated rope would need a length of about 15 tucks per strand to avoid slippage while the inventive splice needs only with 10 or as little as 8 tucks. Such shortening of a splice represents a reasonable gain in weight and employed rope length but a special advantage is the reduced production cost and versatility of the splice in the field since the thickened section of the rope is substantially reduced.

In a preferred embodiment of the invention, the fibres are high strength fibers, sometimes also called high modulus fibres. In the context of the present invention, high strength fibres are fibres having a tensile strength of at least 0.5 N/tex, more preferably of at least 1.2 N/tex, even more preferably of at least 2.5 N/tex, most preferably of at least 3.5 N/tex. When the high strength fibers are UHMWPE fibers, said UHMWPE fiber preferably have a tensile strength of at least 1.2 N/tex, more preferably of at least 2.5 N/tex, most preferably at least 3.5 N/tex. Preferably the high strength fibers have a tensile modulus of at least 30 N/tex, more preferably of at least 50 N/tex, most preferably of at least 60 N/tex. Preferably the UHMWPE fibers having a tensile modulus of at least 50 N/tex, more preferably of at least 80 N/tex, most preferably of at least 100 N/tex. High strength fibres will be assembled into high strength yarns, while such high strength may comprise other fibres of lower strength, preferably high strength yarns substantially consist of high strength fibres.

Examples of inorganic materials suitable for producing high strength fibres of said yarns include steel, glass and carbon. Examples of organic synthetic materials suitable for producing the high strength fibres of said yarns include polyolefins, e.g. polypropyle (PP); polyethylene (PE); ultra-high molecualar weight polyethylene (UHMWPE), polyamides and polyaramides, e.g. poly(p-phenylene terephthalamide) (known as Kevlar®); poly(tetrafluoroethylene) (PTFE); poly(p-phenylene-2,6-benzobisoxazole) (PBO) (known as Zylon®); liquid crystal polymers such as for example copolymers of para hydroxybenzoic acid and para hydroxynaphtalic acid (e.g. Vectran®); poly{2,6-diimidazo-[4,5b-4',5'e]pyridinylene-1,4(2,5-dihydroxy)phenylene} (known as M5); poly(hexamethyleneadipamide) (known as nylon 6,6), poly(4-aminobutyric acid) (known as nylon 6); polyesters, e.g. poly(ethylene terephthalate), poly(butylene terephthalate), and poly(1,4 cyclohexylidene dimethylene terephthalate); but also polyvinyl alcohols and polyacrylonitriles. Also combinations of yarns manufactured from the above referred polymeric materials can be used for manufacturing the strands. It was observed that the rope structure according to the present invention provides rope connections with a substantially lower slippage which are especially suitable for ropes comprising high strength yarns. Spliced ropes from high strength yarns show an increased failure through slippage of the splice, which could be reduced or even avoided by the present invention up to the maximum break load of the high strength fibre comprising ropes.

In a yet preferred embodiment, the polymeric material of choice for producing the yarns is ultrahigh molecular weight (UHMWPE). UHMWPE in the context of the present invention has an IV of preferably between 3 and 40 dl/g. Preferably, the UHMWPE are linear UHMWPE with less than 1 side chain per 100 C atoms, more preferably less than 1 side chain per 300 C atoms as such material provides the yarns with increased mechanical properties wherein a side chain is a group comprising at least 10 C atoms. The UHMWPE yarns are preferably manufactured according to a gel spinning process as described in numerous publications, including for example WO 01/73173 A1, EP 1,699,954. The inventive rope structure proved to be very suitable for ropes comprising UHMWPE high modulus yarns since such yarns may show a low coefficient of friction further promoting the slippage of splices. Therefore, the versatility of a splice comprising UHMWPE yarns is improved.

It was further observed that in multiple applications for rope structures, especially applications involving repeated bending, the ropes, strands, yarns and/or fibres are coated with a variety of functional substances to delay the bending fatigue of such rope systems. The main mechanism is that the employed coatings act as a lubricating layer in-between the fibres, yarns and/or strands, reducing the internal abrasion and frictional heat developed during the bending process. The application of such coatings result in yarns and strand with even reduced coefficient of friction and showed that splices in rope structures comprising such coated yarns present a further increased tendency to slip well before the maximum break load of the rope itself. To the surprise of the inventors was it observed that the present rope structure comprising the described splice is even suitable to perform a slip-free splice when the rope comprises fibres coated with such friction reducing coatings. Hence is a preferred embodiment of the invention a rope system wherein the fibres of the intact and/or loose strands are at least partially coated with a friction reducing agent. By friction reducing agent is herein understood a compound that when applied to the fibre provides a coated fibre with a coefficient of friction inferior to the coefficient of friction of the untreated fibre. There are multiple compounds that may be suitable to reduce the coefficient of friction of the fibres. Typical examples are silicon and/or fluorine based compounds such as silicone oil or fluorinated polymers; hydrocarbon liquid and solid compounds such as oils and waxes. Preferably the fibers are at least partially coated with a silicone or fluorine comprising compound, more preferably the fibres are partially coated with polydimethylsiloxane or polytetrafluoroethylene comprising compounds. As described in WO 2011/015485, which is hereby included by reference, a preferred category of coatings of high strength fibres for bending application are cross-linked silicone polymers. A preferred embodiment of the present invention is a rope system wherein the fibres are at least partially coated with a cross-linked silicone polymer. More preferably the fibres are UHMPE fibres as described in detail above at least partially coated with a cross-linked silicone polymer.

Methods of Measuring

- Intrinsic Viscosity (IV) is determined according to ASTM-D1601/2004 at 135° C. in decalin, the dissolution time being 16 hours, with DBPC as anti-oxidant in an amount of 2 g/l solution, by extrapolating the viscosity as measured at different concentrations to zero concentration.
- Side chains in a polyethylene or UHMWPE sample is determined by FTIR on a 2 mm thick compression molded film by quantifying the absorption at 1375 $cm^{-1}$ using a calibration curve based on NMR measurements (as in e.g. EP 0 269 151)
- Tensile properties, i.e. strength and modulus, of fibers were determined on multifilament yarns as specified in ASTM D885M, using a nominal gauge length of the fibre of 500 mm, a crosshead speed of 50%/min and Instron 2714 clamps, of type Fibre Grip D5618C. For calculation of the strength, the tensile forces measured may be divided by the titre, as determined by weighing 10 meter of fibre; values in GPa for are calculated assuming the natural density of the polymer, e.g. for UHMWPE is 0.97 $g/cm^3$.

The invention will be elucidated with reference to the following experiments.

A number of eye splices have been produced according to the splicing technology of the state of the art (enumerated as comparative Examples A-D in Table 1) as well as according to the inventive splice according to the present invention (mentioned as Experiments 1-7 in Table 1).

All rope structures with eye splices are made starting from a 12 strands torque balanced braided rope of HMPE fibres (construction 12×7×15×1760 dtex Dyneema® SK 78 XBO; SK78 XBO is a product of DSM Dyneema, NL with a tenacity of 3.5 N/tex) further coated with a PDMS (polydimethylsiloxane) coating. The total level of PDMS coating is about 8 wt % based on the total rope mass. The rope has a pitch of about 150 mm and a rope diameter of about 21 mm. For each of the examples 1 to 7 the rope is spliced into an eye splice according to the description above with the loose strands combined into pairs and tucked back over and under crossings of S and Z strands of the intact rope ("double" in Example 1-5 as well as the comparative experiments A to D) or associated pairs with the individual strands tucked back in an 1-over-1-under alternating manner as described above ("single" in Example 6 and 7). Where tapering is performed, it is reported in the table as X-Y-Z (e.g. 6-3-3; that is a splice having 6 full tucks and tapered in two steps of 3 tucks each). Non tapered constructions are reported as X-0-0. The load at break (LaB) of the splices are reported. Said load at break can be achieve either by slippage of the splice, or by physical breakage of the splice construction through rupture.

The spliced breaking strength (or load at break) of the rope structure is determined on a sample length of about 5.15 m, with an pin diameter of 80 mm and after five times applying a pre-load of about 200 kN and at a testing speed of 2000 N/sec.

TABLE 1

| Sample | Construction | Tucked | LaB [kN] | Splice slip |
|---|---|---|---|---|
| A | 15-0-0 | double | 380 | no |
| B | 13-1-1 | double | 375 | yes |
| C | 9-3-3 | double | 345 | yes |
| D | 6-3-3 | double | 300 | yes |
| 1 | 15-0-0 | double | 385 | no |
| 2 | 10-1-1 | double | 360 | no |
| 3 | 10-0-0 | double | 360 | no |
| 4 | 8-1-1 | double | 370 | no |
| 5 | 7-2-1 | double | 375 | slight |
| 6 | 10-0-0 | single | 370 | no |
| 7 | 8-0-0 | single | 350 | no |

Comparative Experiments A to D show the result of the reference splice construction combination with the trend of increased slipping of the splice with reduced number of tucks. A total of 15 full tucks is needed to reach a splice-slippage free break of the splice construction at 380 kN. All shorter splices slip below said maximum LaB.

Splices 1 and 3 according to the invention are based on the inventive concept of X-tucks i.e. by using two intact rope tucks over the loose strands. Several examples are shown with various numbers of X-tucks and tapering. Minimum number of tucks required for the described rope to obtain a non-slipping splice slip for the given rope construction is 10, resulting in a final breaking strength of about 370 kN which is incrementally lower than the reference sample, but employing a splice being 33% reduced in length.

Examples 2, 4 and 5 explore the effect of tapering of the low-slip splice. Tapering of a splice is applied since it has a positive effect on the maximum breaking strength of the rope structure. From these examples it can be concluded that apparently it requires several tucks to realize this desired effect of higher breaking strength. Tapering seems to be a quite sensitive tool. When applied in a 8-X-X configuration the 7-2-1 concepts show a slight degree of splice slip while the 8-1-1 performs without slip.

Examples 6 and 7 demonstrate the further improvement of the 1-over-1-under concept of associated strands, the 10-0-0 splice can be shortened to 8-0-0 to obtain a non-slipping splice while maintaining 350 kN breaking strength.

The invention claimed is:

1. A rope system comprising a splice structure, wherein the splice structure comprises:

an intact portion comprising at least 8 intact strands, and a disassembled portion comprising at least 4 loose strands, wherein the intact portion is a braid of at least 4 S-oriented intact strands and at least 4 Z-oriented intact strands, wherein the braid comprises X-tucks of intact strands which comprise at least one of the S-oriented intact strands and at least one of the Z-oriented intact strands, respectively, and wherein at least one of the loose strands of the disassembled portion passes under and over intact strands of the intact portion such that the at least one loose strand passes at least once under and at least once over at least one first X-tuck and at least one second X-tuck of intact strands, respectively.

2. The rope system according to claim 1, wherein each loose strand of the disassembled portion passes under and over the intact strands of the intact portion, wherein each loose strand passes under at least one of the first and second X-tucks of intact of strands.

3. The rope system according to claim 1, wherein each loose strand passes at least once under and at least once over the at least one first X-tuck and the at least one second X-tuck of intact strands, respectively.

4. The rope system according to claim 1, wherein at least 2 of the loose strands are combined into at least one bundle of loose strands, and wherein the at least one bundle of loose strands passes under the at least one first X-tuck of intact strands and the at least one second X-tuck of intact strands, respectively.

5. The rope system according to claim 4, wherein all of the loose strands are combined into bundles of at least 2 loose strands.

6. The rope system according to claim 1, wherein all of the loose strands are combined in pairs of associated loose strands, and wherein a first one of the pairs of associated loose strands passes at least once under and once over the at least one first X-tuck and the at least one second X-tuck of intact strands, respectively, and wherein a second one of the pairs of associated loose strands passes over and under the at least one first X-tuck and the at least one second X-tuck of intact strands, respectively.

7. The rope system according to claim 1, wherein at least one of the loose strands passes at least n times under n first X-tucks of intact strands and at least n times over n second X-tucks of intact strands, respectively, wherein is 2.

8. The rope system according to claim 1, wherein a fraction of the loose strands passes at least 2 times under the at least one first and second X-tucks, respectively.

9. The rope system according to claim 1, wherein the splice structure is an eye splice between an intact portion and a disassembled portion of the same rope, and wherein the intact strands and loose strands are portions of the same rope strands.

10. The rope system according to claim 1, wherein the splice structure is a connecting splice between an intact portion of a first rope end and a disassembled portion of a second rope end.

11. The rope system according to claim 10, further comprising a second splice structure comprising an intact portion of the second rope end and a disassembled portion of the first rope end.

12. The rope system according to claim 1, wherein the splice structure comprises natural or synthetic fibers.

13. The rope system according to claim 1, wherein the intact and/or loose strands comprise fibers that are at least partially coated with a friction reducing agent.

14. The rope system according to claim 4, wherein the at least one bundle of loose strands comprises a pair of the loose strands.

15. The rope system according to claim 5, wherein each bundle is a pair of the loose strands.

16. The rope system according to claim 6, wherein each of the pairs of associated loose strands passes at least once under and once over the at least one first and the at least one second X-tucks of intact strands, respectively.

17. The rope system according to claim 16, wherein each of the pairs of associated loose strands passes at least n times under and at least n times over n first and n second X-tucks of intact strands, respectively, wherein n is 2.

18. The rope system according to claim 17, wherein n is 3.

19. The rope system according to claim 17, wherein n is 4.

20. The rope system according to claim 7, wherein n is 3.

21. The rope system according to claim 7, wherein n is 4.

22. The rope system according to claim 1, wherein all of the loose strands pass at least n times under the intact strands of the at least one first X-tuck and at least n times over the intact strands of the at least one second X-tuck, wherein n is 2.

23. The rope system according to claim 22, wherein n is 3.

24. The rope system according to claim 22, wherein n is 4.

25. The rope system according to claim 12, wherein the splice structure comprises high modulus synthetic fibers.

26. The rope system according to claim 25, wherein the high modulus synthetic fibers are ultrahigh molecular weight polyethylene (UHMWPE) fibers having a tensile strength of at least 1.2 N/tex.

27. The rope system according to claim 1, wherein the splice structure is an end-to-end splice between two or more ropes or to join ends of the same rope to form a circular grommet or round sling.

28. The rope system of claim 13, wherein the friction reducing agent is a compound comprising silicone or fluorine.

29. The rope system of claim 13, wherein the fibers are partially coated with a compound comprising polydimethylsiloxane or polytetrafluoroethylene.

30. The rope system of claim 13, wherein the friction reducing agent is a cross-linked silicone polymer.

* * * * *